US008231401B2

(12) United States Patent
Amano et al.

(10) Patent No.: US 8,231,401 B2
(45) Date of Patent: Jul. 31, 2012

(54) CONNECTOR

(75) Inventors: Takamaru Amano, Yokkaichi (JP); Tsutomo Tanaka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 65 days.

(21) Appl. No.: 12/824,625

(22) Filed: Jun. 28, 2010

(65) Prior Publication Data

US 2011/0008989 A1 Jan. 13, 2011

(30) Foreign Application Priority Data

Jul. 8, 2009 (JP) ..... 2009-161746
Jul. 8, 2009 (JP) ..... 2009-161754

(51) Int. Cl.
*H01R 13/62* (2006.01)

(52) U.S. Cl. ..... 439/357

(58) Field of Classification Search ..... 439/350, 439/353, 354, 357, 358
See application file for complete search history.

(56) References Cited

U.S. PATENT DOCUMENTS 6,858,890 B2 * 2/2005 Jacob et al. ..... 257/296
2005/0215106 A1 * 9/2005 Holub ..... 439/357
2007/0155218 A1 * 7/2007 Wu ..... 439/358

FOREIGN PATENT DOCUMENTS

JP 2009-224998 10/2009

* cited by examiner

*Primary Examiner* — Ross Gushi
(74) *Attorney, Agent, or Firm* — Gerald E. Hespos; Michael J. Porco

(57) ABSTRACT

A connector is provided with a housing 10 connectable with a mating housing 80. A lock arm 19 includes a support 21 that stands up from the housing 10. An arm portion 22 is cantilevered forward in a connecting direction CD from the support 21 and is adapted to hold the two housings 10, 80 in a connected state by a locking movement of the arm portion 22 when the two housings 10, 80 are connected properly. Pressable portions 33 are formed on the housing 10 behind the support 21 in the connecting direction and face the support 21. The pressable portions 33 are pressable in the connecting process.

8 Claims, 13 Drawing Sheets

CONNECTOR

BACKGROUND OF THE INVENTION

1. Field of the Invention

The present invention relates to a connector.

2. Description of the Related Art

Japanese Unexamined Patent Publication No. 2008-66030 discloses a connector with a housing that is connectable with a mating housing. A lock arm stands up from the upper surface of the housing and then extends forward. A mating lock is formed on the mating housing. The lock arm resiliently engages the mating lock when the two housings are connected properly to hold the housings in a connected state.

The housing is formed with protection walls that cover a rear end portion of the lock arm to prevent the lock arm from being unlocked inadvertently. Further, R-surfaces are formed on upper corners of the rear ends of the protection walls. The two housings are connected while these R-surfaces are pressed.

A finger that presses the above-described R-surfaces may slip to a free end of the lock arm and may inadvertently deform the lock arm. The lock arm hits a surface of the mating housing upon its returning movement when the two housings are connected properly and gives off a locking sound. However, the locking sound may not be sufficiently large if a finger inadvertently deforms the lock arm, thereby dulling lock feeling.

A large elevation difference exists between the upper extending ends of the protection walls of the above-described connector and the intermediate part of the lock arm. Thus, the finger needs to be inserted deeply into the unlocking space. However, the opening area of the unlocking space is specified according to the size of the housing and the opening area is not increased easily. As a result, the protection walls occasionally hinder the insertion of the finger tip before reaching the intermediate part of the lock arm. Accordingly, the locking arm of the above-described connector has been difficult to unlock and operational efficiency is poor.

The invention was developed in view of the above situation and an object thereof is to improve overall operational efficiency of the locking process.

SUMMARY OF THE INVENTION

The invention relates to a connector with a housing that is connectable with a mating housing. The housing has a lock arm with a support that projects up from the housing and a resiliently deformable arm portion cantilevers forward from the support in a connecting direction. The arm portion is configured to hold the two housings in a properly connected state. At least one pressable portion is formed on the housing behind the support and is connected with or faces the support. The pressable portion is pressable in a connecting process so that the housing can be pushed straight in the connecting direction during the connecting process. Thus, the housings can be connected correctly.

Further, the finger will not move to and press the free end of the lock arm to deform the lock arm inadvertently resiliently. As a result, good lock processing and feeling is obtained, thereby leading to an improved overall operability of the locking process.

A distance between opposite sides of the pressable portion in a width direction orthogonal to the connecting direction is substantially equal to or longer than a distance between the opposite widthwise sides of the arm. Thus, a wide pressing range is ensured and the pressable portion can be pressed easily even if the connector is small.

At least one hook preferably is formed between the extending end of the support and the pressable portion to function as a finger rest. A finger that rests on the hook is not likely the slip off in the connecting process of the two housings.

The housing preferably has a front wall for at least partly covering and protecting a free end of the arm portion. Thus, the lock arm is not likely to be deformed inadvertently.

The housing preferably has a rear wall for at least partly covering a base end of the arm portion and the support. Thus, the lock arm is not likely to be deformed inadvertently.

An unlocking space preferably is defined between the front wall and the rear wall for permitting entry of a finger upon separating the two housings. Thus, the lock arm easily can be deformed resiliently in an unlocking direction by inserting a finger into the unlocking space upon separating the two housings.

The rear wall preferably is at substantially the same position or at a higher position than the front wall in a height direction orthogonal to the connecting direction. Thus, an operator is not likely to press the front wall erroneously in the process of connecting the housings, unlike the case where the front wall is higher than the rear wall.

The arm portion preferably has two arm bodies that are spaced apart in a width direction orthogonal to the connecting direction. Two pressable portions are formed to correspond to the respective arm bodies so that a pressing force is given in a concentrated manner to a part of the lock arm corresponding to the rear end of the support in the connecting direction. Thus, the housing is pushed in the connecting direction and the two housings are more stably connected.

The pressable portion preferably has at least one pressable surface that is inclined toward a side at which the support projects. Thus, the finger easily can be placed on the pressable surface and operability is improved. Further, the inclined surface serves as an index in recognizing the pressable portion. Accordingly, the operator is not likely to press a part other than the pressable portion erroneously.

The invention also relates to a connector with a housing that is connectable with a mating housing. At least one lock arm is formed on the housing and is cantilevered from a base end to a leading end. The lock arm is adapted to hold the housing and the mating housing in a connected state. A first wall is formed on the housing and is arranged to cover a base end of the lock arm. A second wall also is formed on the housing and is arranged to cover a leading end portion of the lock arm. An unlocking space is defined the first and second walls and is used to perform an unlocking operation to an intermediate part of the lock arm. Protection walls project up from the housing at opposite sides of the lock arm and close opposite sides of the unlocking space. The protection walls are cut off up to positions more inward or lower than the first and second walls and more outward or higher than the intermediate part of the lock arm, thereby forming steps.

The housings can be separated from each other by inserting a finger into the unlocking space and pressing the intermediate part of the lock arm with the tip of the finger so that the lock arm is displaced in the unlocking direction. Both protection walls are cut off at positions lower than the first and second walls. Thus, the lock arm can be unlocked by inserting the finger through the stepped portion and without inserting the finger deeply into the unlocking space. In other words, partial insertion of the finger is not hindered by the protection walls so that operability of the unlocking operation and, thus, overall operability is improved.

The mating housing is formed with a mating lock that is engageable with the lock arm for locking. The mating lock portion is arranged outside the unlocking space in a connected state of the two housings. Thus, the finger tip will not interfere with the mating lock when the finger is inserted into the unlocking space. Therefore smooth operability is ensured during the unlocking operation.

The steps are displaced from the mating lock so that the mating lock is hidden when viewed sideways in the connected state of the two housings. Thus, external matter will not interfere with the mating lock from outer lateral sides.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A connector in accordance with a first embodiment of the invention has a housing 10 and terminal fittings 60 mounted in the housing 10 as shown in FIGS. 1 to 6. The housing 10 is connectable with a mating housing 80. In the following description, ends of the housings 10 and the mating housing 80 that are to be connected are referred to as front ends concerning forward and backward directions FBD.

Figure 1:
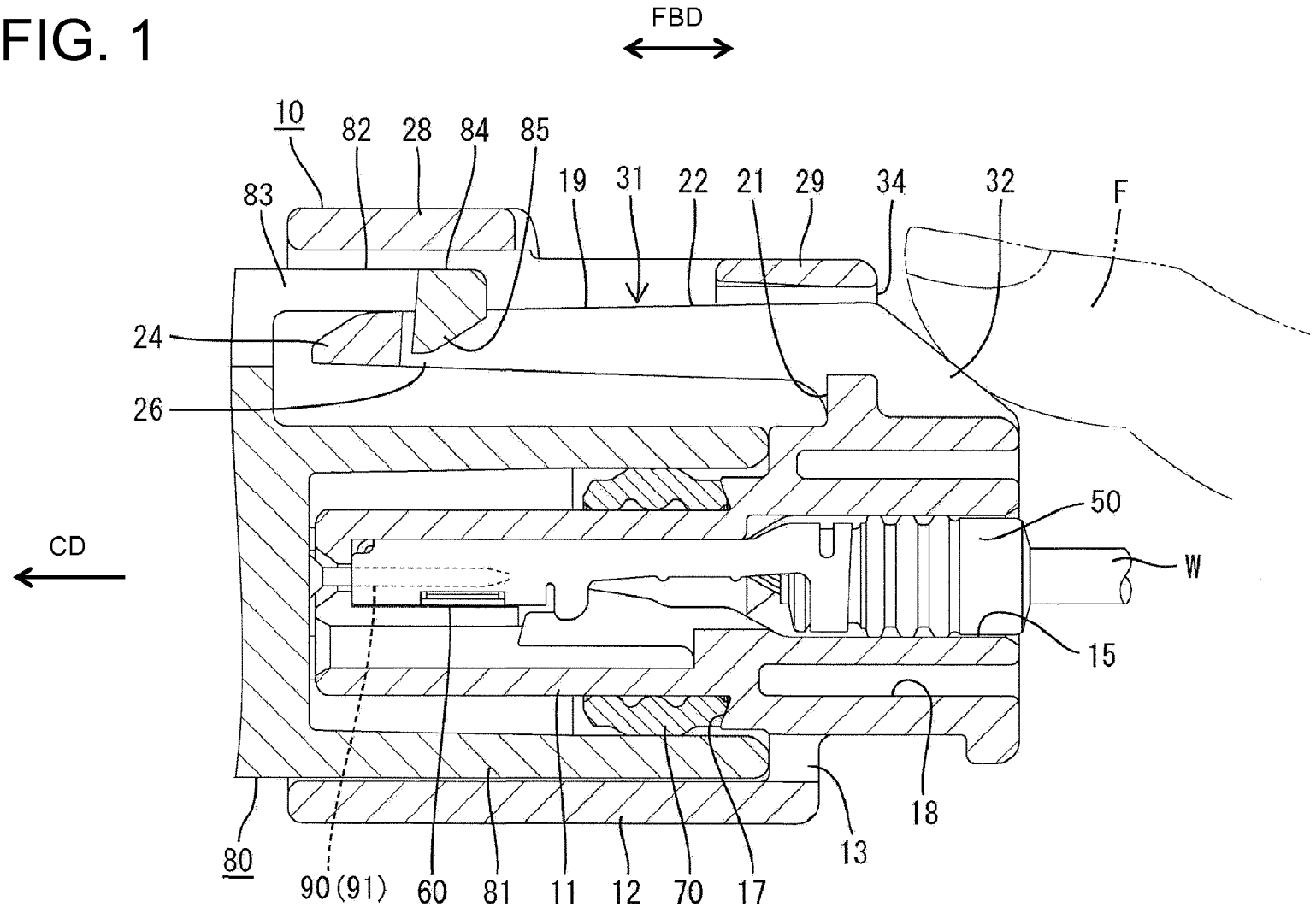
FIG. 1 is a sectional view of two housings in a connected state in a connector according to a first embodiment.

The mating housing 80 is made e.g. of synthetic resin and includes a wide tubular receptacle 81, as shown in FIG. 1. Male tabs 91 of mating terminal fittings 90 are mounted through a back wall of the receptacle 81 so that leading ends of male tabs 91 of the mating terminal fittings 90 project into the receptacle 81. A locking piece 82 projects up and then forward from the upper surface of the mating housing 80 and disengagement hole 83 opens in the rear surface of the lock piece 82. An engaging body 84 extends substantially in a width direction before the disengagement hole 83 and near the leading end of the lock piece 82. A lock claw 85 projects down from the engaging body 84.

Figure 2:
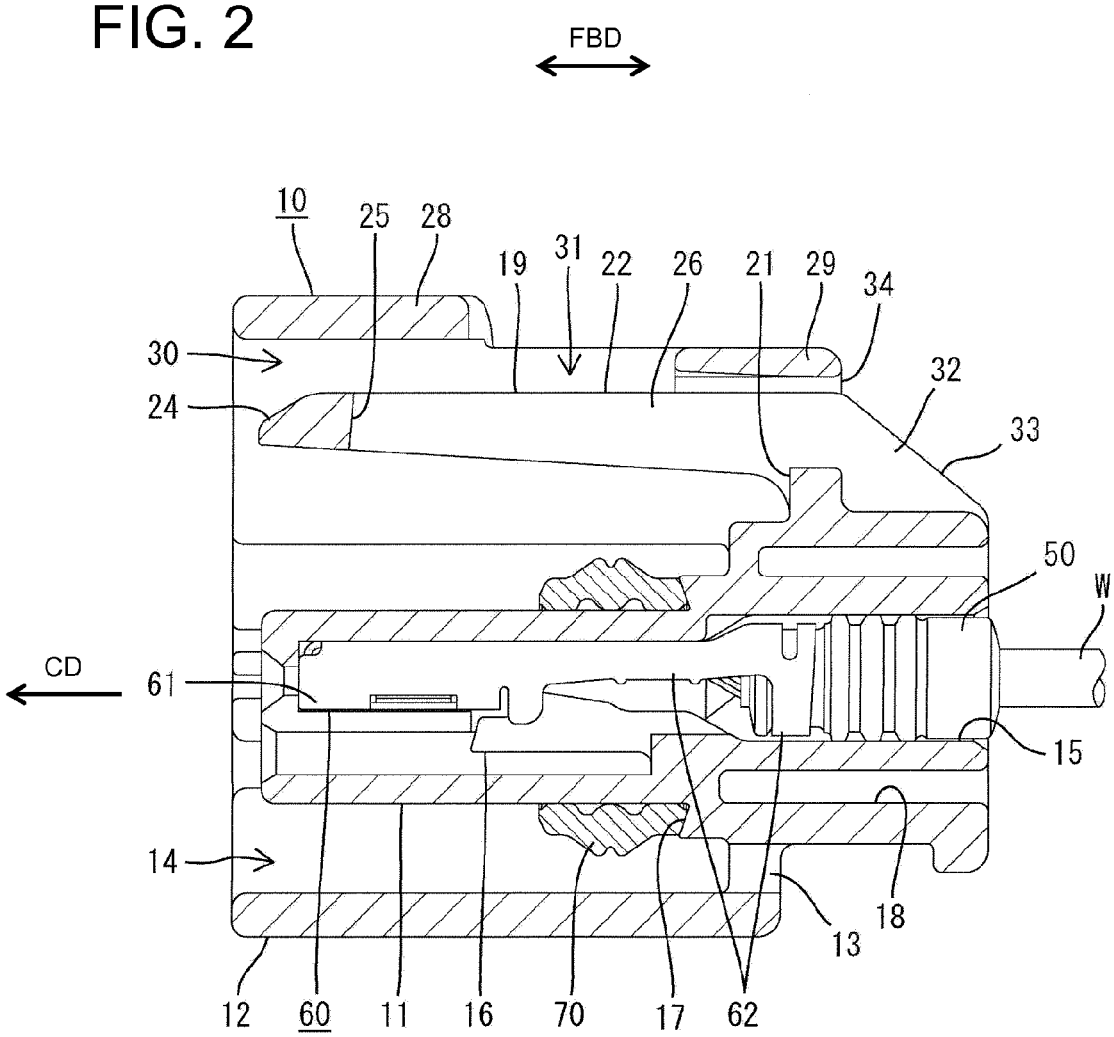
FIG. 2 is a sectional view of the housing.
Figure 3:
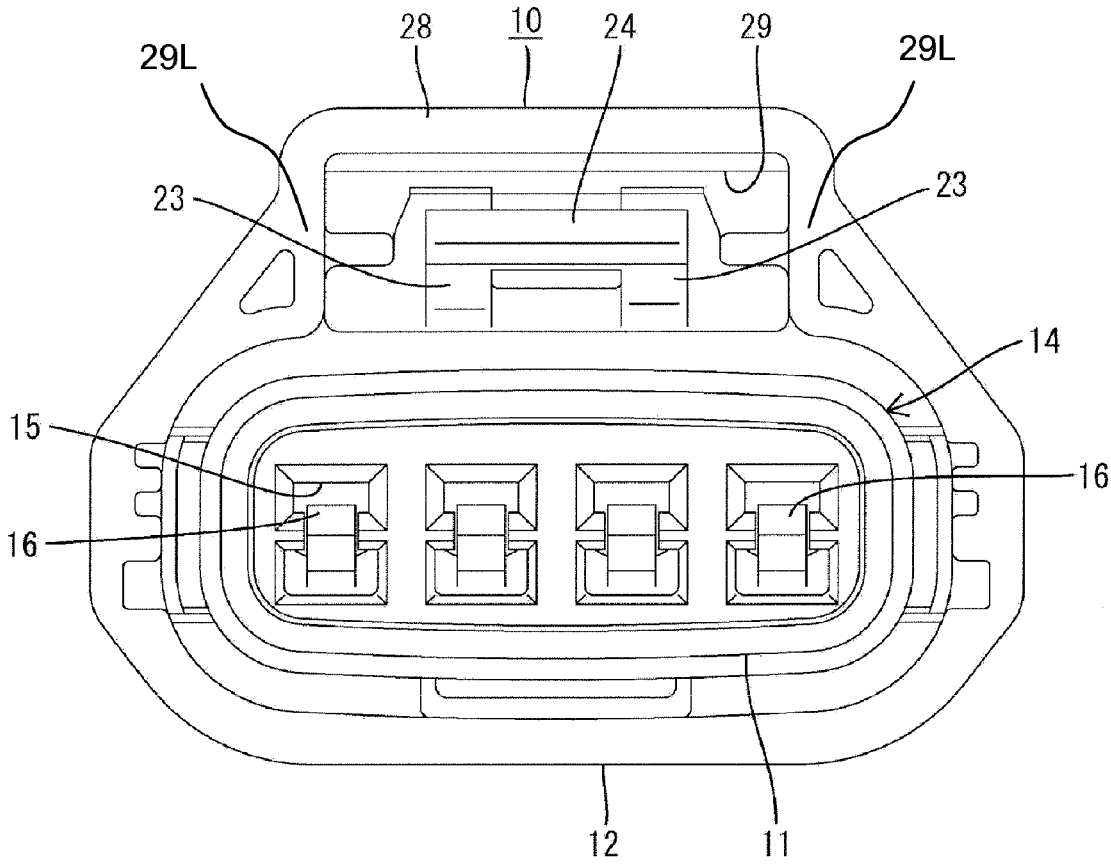
FIG. 3 is a front view of the housing.
Figure 4:
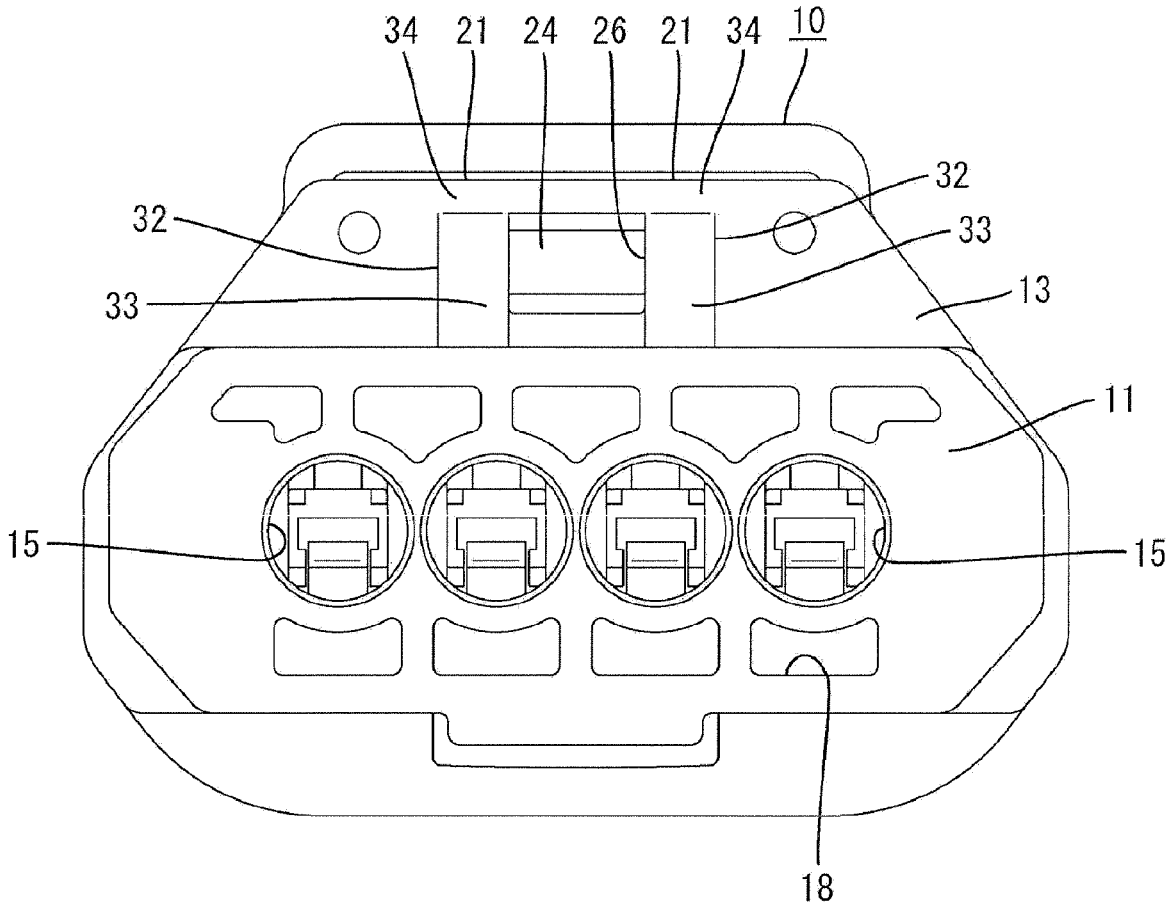
FIG. 4 is a rear view of the housing.

The housing 10 is made e.g. of synthetic resin and has a housing main body 11 substantially in the form of a wide block. A wide fitting tube 12 surrounds the housing main body 11, as shown in FIGS. 2 and 3, and a joining portion 13 unitarily joins the housing main body 11 and the fitting tube 12. The joining portion 13 is connected with the housing main body 11 at a position slightly behind a center of the housing main body 11 in forward and backward directions FBD. A connection space 14 is defined between the housing main body 11 and the fitting tube 12 and can receive the receptacle 81 of the mating housing 80.

Cavities 15 are formed substantially side by side in the housing main body 11 and a terminal fitting 60 is inserted into each cavity 15 from behind. A resiliently deformable locking lance 16 projects forward from the lower surface of each cavity 15. The locking lance 16 resiliently engages the properly inserted terminal fitting 60 and prevents the terminal fitting 60 from coming out backward.

An overhanging or undercut step 17 is formed on the outer peripheral surface of the housing main body 11 so that a part of the housing main body 11 behind the step 17 is more outward than a part before it. A seal ring 70 made of resilient material, such as rubber, is mounted on the outer peripheral surface of the housing main body 11 before the step 17. This seal ring 70 is held in close contact with the two housings 10, 80 when the housings 10, 80 are connected properly and functions to seal between the housings 10, 80. Bores 18 are formed around the respective cavities 15 in the rear surface of the housing main body 11, and back ends of the bores 18 are located right behind the step 17.

Each of the terminal fittings 60 to be inserted into the respective cavities 15 is formed unitarily, for example, by bending, folding and/or embossing an electrically conductive metal plate. Each terminal fitting 60 includes a substantially tubular connecting portion 61 at its front end and a wire connection portion with at least one barrel 62 at the rear end. The male tab 91 of the mating terminal fitting 90 is inserted into the connecting portion 61 from the front and along a connecting direction CD for electrically connecting the two terminal fittings 60, 90. A front end of the barrel 62 is crimped, bent, folded or deformed and connected with a core exposed at an end of the wire W. A rear end of the barrel 62 is crimped, bent, folded or deformed and connected with a resilient rubber plug 50 mounted on an end of insulation coating of the wire W. The rubber plug 50 is inserted into the cavity 15 together with the terminal fitting 60 and closely contacts the inner circumferential surface of the cavity 15 for sealing the interior of the cavity 15.

A substantially cantilever-shaped lock arm 19 is formed on the upper outer surface of the housing main body 11. The lock arm 19 includes a support 21 that projects unitarily out from the upper surface of the housing main body 11 and an arm portion 22 that extends forward from the support 21. The arm portion 22 is resiliently deformable in vertical directions (a direction intersecting the connecting direction CD) relative to the support 21. The support 21 is located at substantially the same position as the joining portion 13 in forward and backward directions FBD and is unitary to the joining portion 13 connected with the upper surface of the housing main body 11 in the width direction (see FIG. 4).

Figure 5:
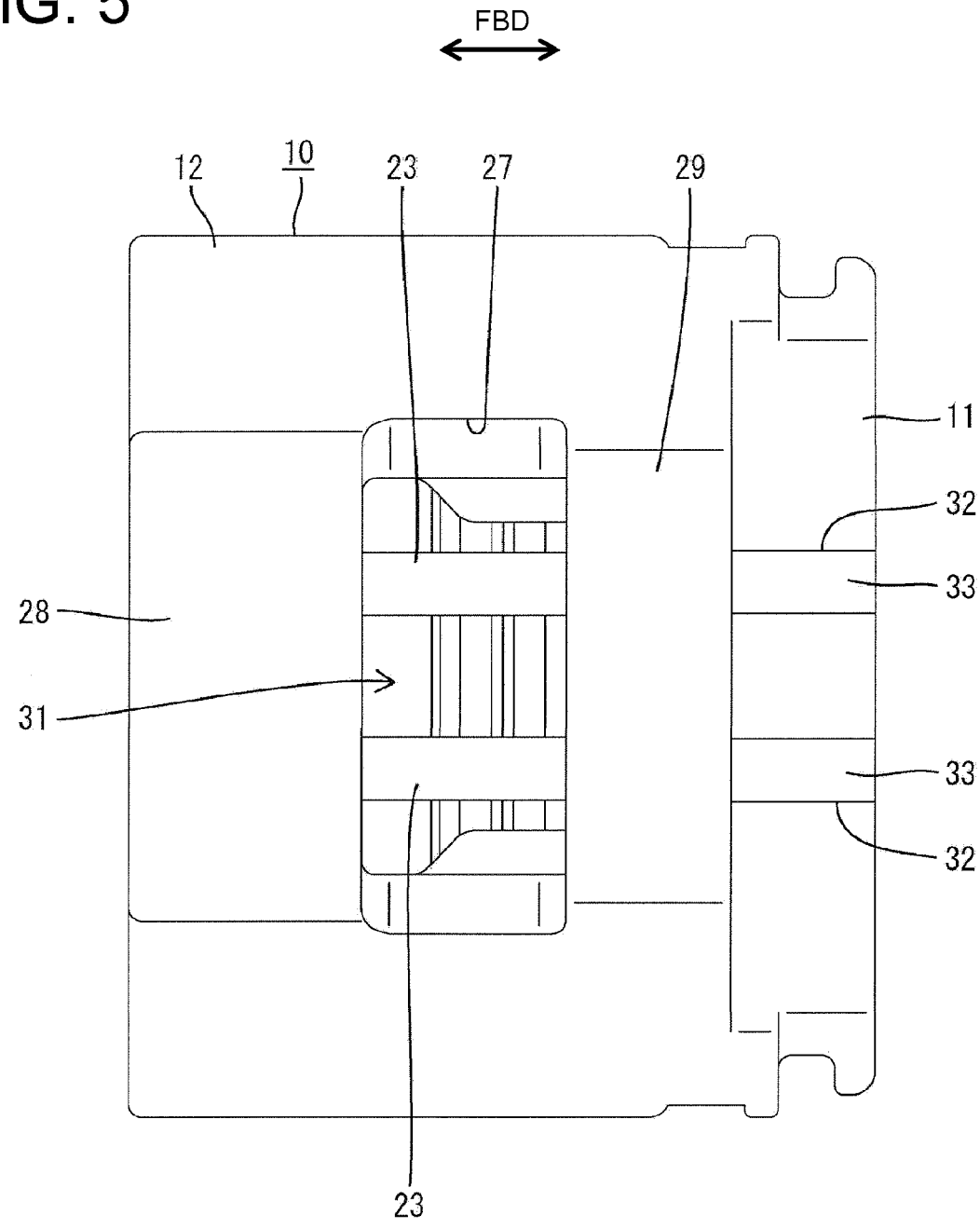
FIG. 5 is a plan view of the housing.
Figure 6:
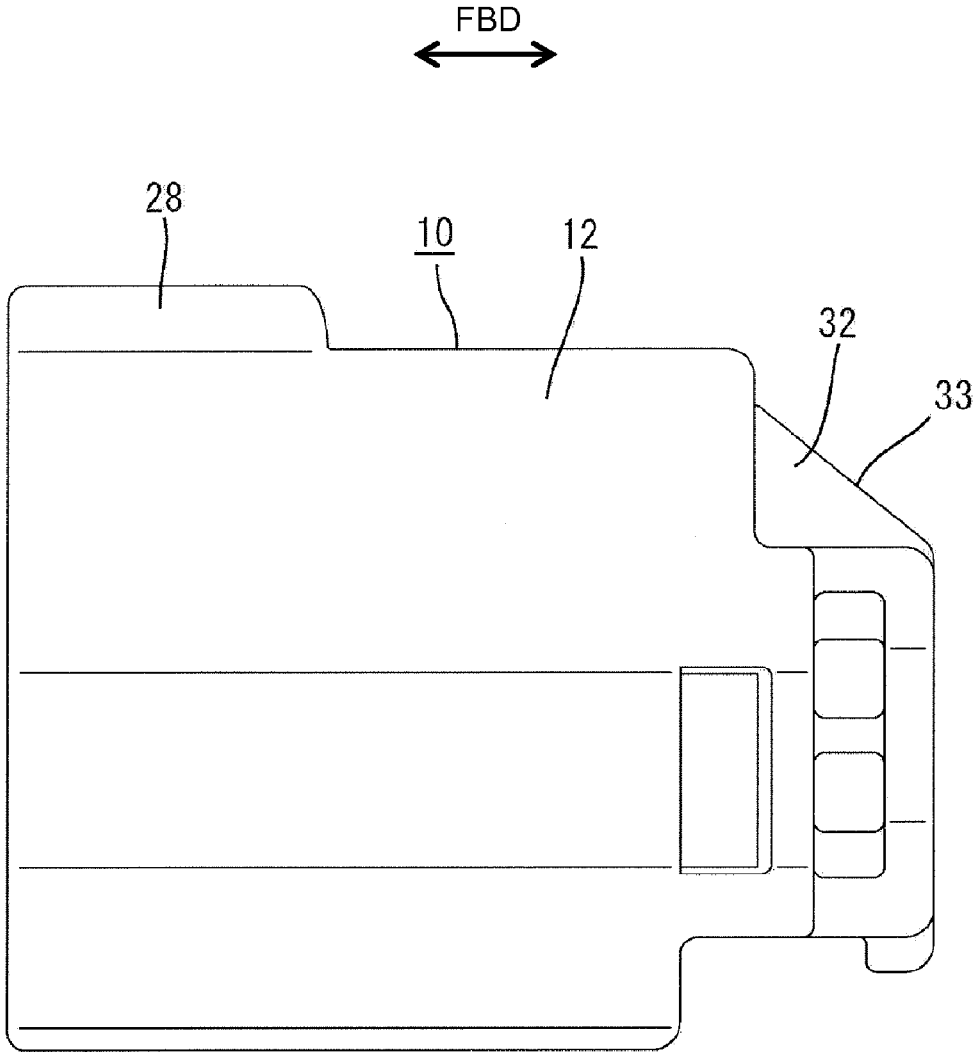
FIG. 6 is a side view of the housing.

The arm portion 22 includes two arm bodies 23 spaced apart in the width direction as shown in FIG. 5. The base ends of both arm bodies 23 are connected unitarily with the front end of the support 21. A locking body 24 extends substantially in the width direction between the leading ends of the arm bodies 23 for unitarily joining the leading ends of the arm bodies 23. A locking surface 25 is defined at the rear of the locking body 24 and locks with the mating lock piece 82 when connecting the two housings 10, 80. A lock hole 26 is formed behind the locking body 24 and between the arm bodies 23 and opens in the rear surface of the lock arm 19.

A wide rectangular opening 27 is formed in the fitting tube portion 12 above an intermediate part of the arm portion 22. A front wall 28, a rear wall 29 and lateral protection walls 29L are formed at the front, rear and lateral sides of the opening 27 to bulge out. The front wall 28 is arranged to cover the leading end of the arm portion 22 including the locking body 24 from above. The rear wall 29 is arranged to cover the base end of the arm portion 22 from above. As shown in FIG. 2, an entrance space 30 is defined between the front wall 28 and the arm portion 22 for receiving the lock piece 82 and the front wall 28 is located higher than the rear wall 29 by that much.

The front wall 28 is thicker than the rear wall 29 and longer than the rear wall 29 in forward and backward directions FBD. The rear end of the rear wall 29 is connected unitarily with the support 21 and the joining portion 13 at the opposite widthwise sides thereof and is arranged to at least partly cover the rear end of the lock hole 26 from above. The opening 27 formed between the front wall 28 and the rear wall 29 defines an unlocking space 31 dimensioned to receive the tip of a finger F. The finger F is inserted into the unlocking space at the time of separating the two housings 10, 80.

Two laterally spaced pressable portions 32 project from the upper surface of the housing main body 11 adjacent to and behind the support 21. The pressable portions 32 can be by pushed the finger F in the process of connecting the two housings 10, 80. The pressable portions 32 have identical sizes and shapes and are at positions corresponding to the two arm bodies 23. The width of each pressable portion 32 is substantially equal to the widths of the support 21 and the arm portion 22, and a distance between opposite widthwise ends of the pressable portions 32 substantially equals the distance between widthwise ends of the support 21 and between widthwise ends of the arm portion 22. Thus, the pressable portions 32 are within a projection range of the lock arm 19 in the width direction and do not project laterally beyond the lock arm 19.

The pressable portions 32 have substantially triangular shapes when viewed sideways, and front ends of the pressable portions 32 are connected unitarily with the rear end of the support 21 and the lower ends of the pressable portions 32 are connected unitarily with the upper surface of the housing main body 11. Inclined surfaces 33 are formed at the rear ends of the pressable portions 32 and incline up toward an upward projection of the support 21. The finger F can be placed closely along the inclined surfaces 33. Specifically, the inclined surfaces 33 are sloped up from the upper surface of the housing main body 11 to the rear end of the support 21. Rear ends of the inclined surfaces 33 substantially coincide with the rear end of the housing main body 11, and the upper ends thereof are slightly below the upper end of the support 21. A substantially step-shaped finger stop 34 is formed between the upper end of the rear surface of the support 21 and the upper ends of the inclined surfaces 33. The tip of the finger F can rest in contact with the finger stop 34, so that the finger F does not slip any further forward.

The housings 10, 80 are arranged opposite to each other along the connecting direction CD to start a connecting operation. The inclined surfaces 33 of the pressable portions 32 then are pressed by the finger F from behind. As a result, a forward pressing force is given to the rear end of the support 21, the lock arm 19 is pushed straight forward in the connecting direction CD and the housing 10 is held in a proper connecting posture. The locking body 24 slides in contact with the tip of the lock claw 85 in the connecting process to deform the arm portion 22 down and in along a direction intersecting the connecting direction CD. The arm portion 22 resiliently returns when the housings 10, 80 are connected properly to snap the lower surface of the lock piece 82, thereby giving off a locking sound. Hence, the lock claw 85 fits into the lock hole 26 from above and engages the locking body 24 (see FIG. 1). In this way, the housings 10, 80 are held inseparably. With the two housings 10, 80 thus held in the properly connected state, the front wall 28 at least partly covers the lock claw 85 from above so that the lock claw 85 is hidden behind the front wall 28 when viewed from above (see FIG. 5).

The housings 10, 80 may be separated for maintenance or the like by inserting the finger F from above and into the unlocking space 31 between the front and rear walls 28 and 29. Thus, the tip of the finger F presses the intermediate parts of both arm bodies 23 from above and the arm portion 22 resiliently deforms down relative to the support 21 in an unlocking direction. This deformation causes the locking body 24 to disengage from the engaging body 84 so that the two housings 10, 80 can be pulled in opposite directions and separated. The lock claw 85 is retracted from the unlocking space 31. Accordingly, the tip of the finger F will not hinder the unlocking operation by contacting the lock claw 85 and injury is avoided.

As described above, the pressable portions 32 are behind and connected with the support 21 of the lock arm 19. Thus, forces exerted on the pressable portions 32 push the housing 10 straight in the connecting direction CD and toward the mating housing 80, with the two housings 10, 80 being held in proper connecting postures.

The finger F is not likely to move to the free end of the lock arm 19 in the connecting process of the housings 10, 80 because the pressable portions 32 that are pushed by the finger F are behind the support 21. Thus, the lock arm 19 is not likely to be deformed inadvertently. Thus, unlike the case where the upper corner of the rear end of the lock arm is pressed, the lock arm 19 undergoes a correct returning movement when the two housings 10, 80 are connected properly and a proper locking sound is given off when the lock arm 19 hits the mating housing 80. As a result, good locking results and feeling are obtained. More particularly, the tip of the finger F rests on the finger stop 34 of the support 21 in the connecting process, and reliably is prevented from slipping and moving toward the free end of the lock arm 19.

The distance between the opposite widthwise ends of the pressable portions 32 equals the distance between the opposite widthwise ends of the arm portion 22. Thus, a wide area for pressing the pressable portions 32 is ensured and the pressable portions 32 can be pressed easily even if the connector is small.

The pressable portions 32 align with the arm bodies 23. Thus, a pressing force is given in a concentrated manner to a part of the lock arm 19 corresponding to the rear side of the support 21 in the process of connecting the two housings 10, 80. Thus, the housing 10 is pushed along the connecting direction CD and stability of the housings 10, 80 in the connecting operation is improved.

The pressable portions 32 have the inclined pressing surfaces 33 that slope out toward the side at which the support 21 projects. Thus, the finger F can be placed easily on the inclined surfaces 33. In addition, the inclined surfaces 33 define indices for recognizing the pressable portions 32, and an operator will not erroneously press a part other than the pressable portions 32.

Figure 7:
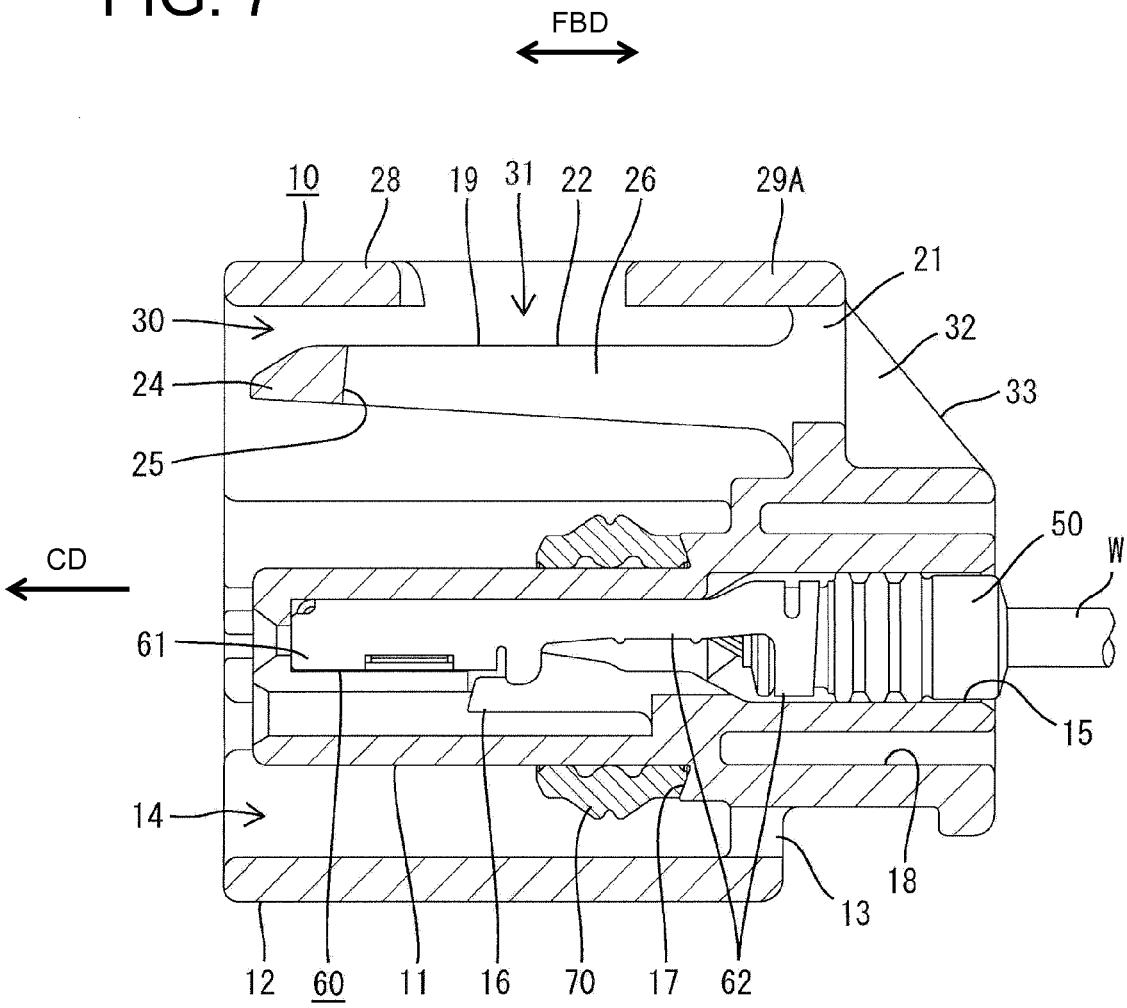
FIG. 7 is a sectional view of a housing in a connector according to a second embodiment.

FIG. 7 shows a second embodiment of the invention. In the second embodiment, the shape and the like of a rear wall 29A differ from those of the first embodiment. Other elements are similar to or substantially the same as in the first embodiment. Elements similar to or substantially the same as those of the first embodiment are denoted by the same reference numerals, but are not described again.

In the second embodiment, the upper surface of the rear wall 29A is at substantially the same height as a front wall 28, i.e. the height of the rear wall 29A is shifted up as compared with the first embodiment. Accordingly, the height of a support 21 is increased and inclined surfaces 33 of pressable portions 32 are steeper. Further, the upper end of the surrounding wall of the fitting tube 12 between the rear wall 29A and the front wall 28 is substantially continuous with and at the same height as the upper or outer ends of the rear and front walls 29A and 28. Further, the rear wall 29A has the same thickness as the front wall 28.

The rear and front walls 29A and 28 are at substantially the same height in the second embodiment. Thus, the erroneous pressing of the front wall 28 by an operator is avoided more effectively in the process of connecting the two housings 10, 80.

A third embodiment of the invention is described with reference to FIGS. 8 to 13. A connector of this embodiment has a housing 110 connectable in a connecting direction CD with a mating housing 160, and terminal fittings 180 can be mounted into the housing 110. In the following description, ends of the housings 110, 160 to be connected are referred to as front ends concerning forward and backward directions FBD.

Figure 8:
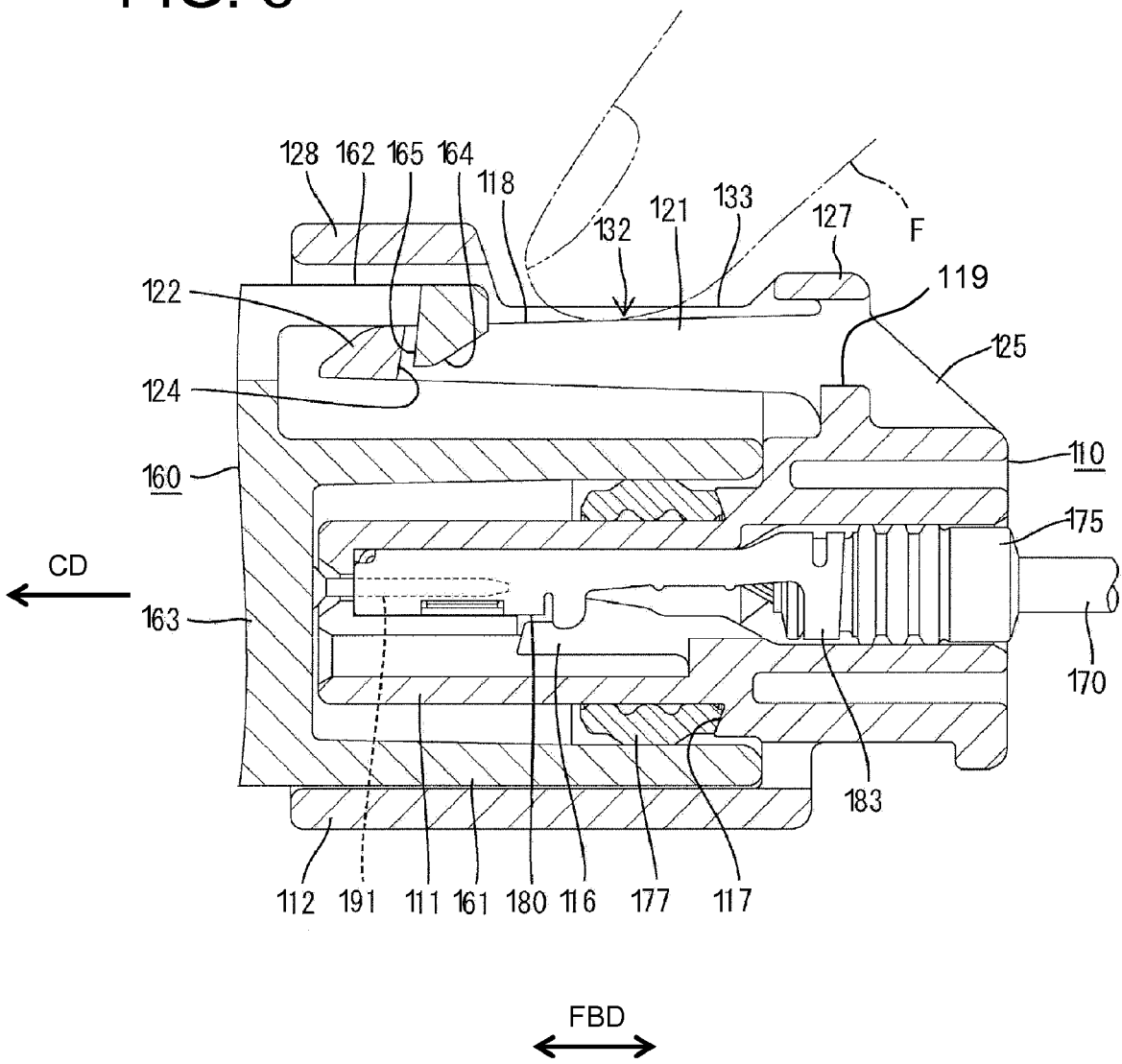
FIG. 8 is a sectional view of a housing properly connected with a mating housing in a connector according to a third embodiment.

The mating housing 160 is made e.g. of synthetic resin and includes a substantially tubular receptacle 161 as shown in FIG. 8. Male tabs 91 of respective mating terminal fittings project into the receptacle 161. A mating lock 162 is formed on the upper end of a back wall 163 of the receptacle 161. The mating lock 162 stands up from the upper end of the back wall 163 and then projects forward. A lock claw 164 projects down and in from the leading end of the mating lock 162. An engaging surface 165 is defined at the rear of the lock claw 164 and is engageable with a mating lock arm 118 for locking.

Figure 9:
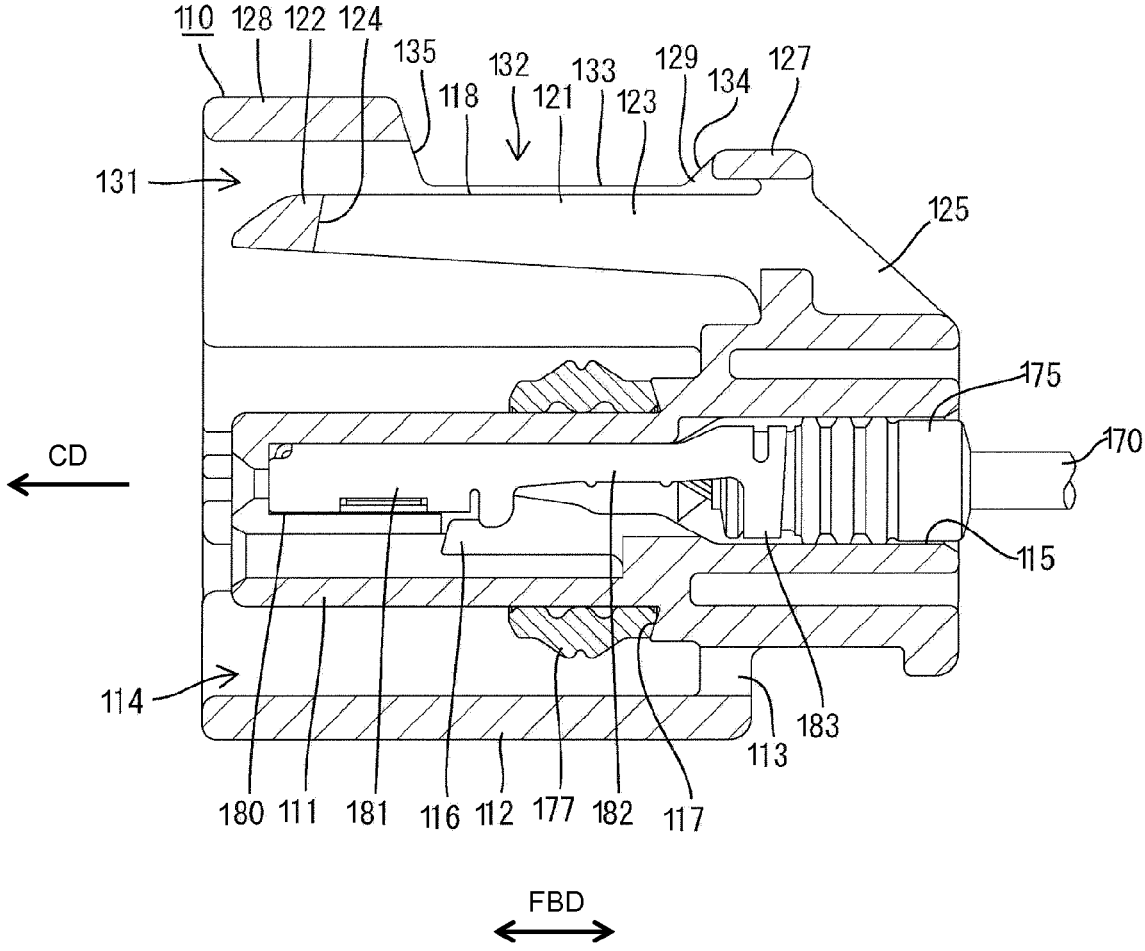
FIG. 9 is a sectional view of the housing.
Figure 10:
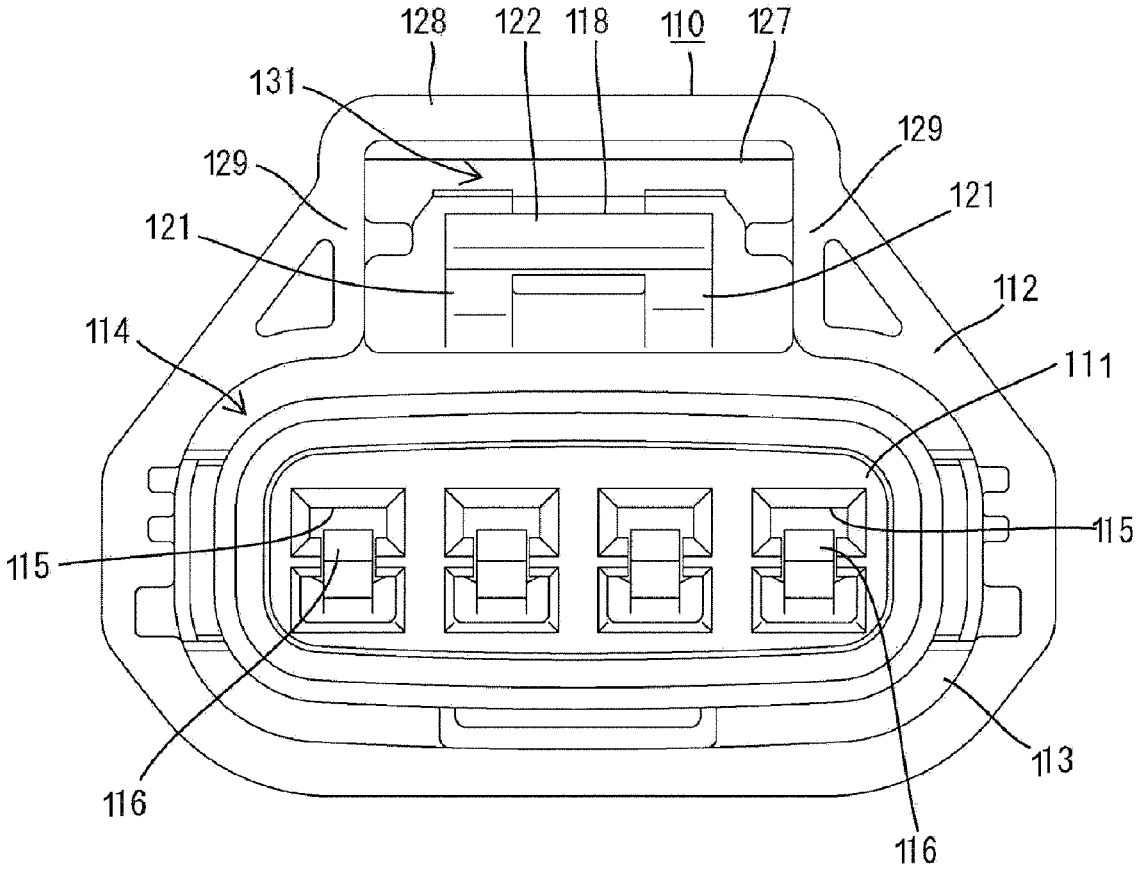
FIG. 10 is a front view of the housing.
Figure 11:
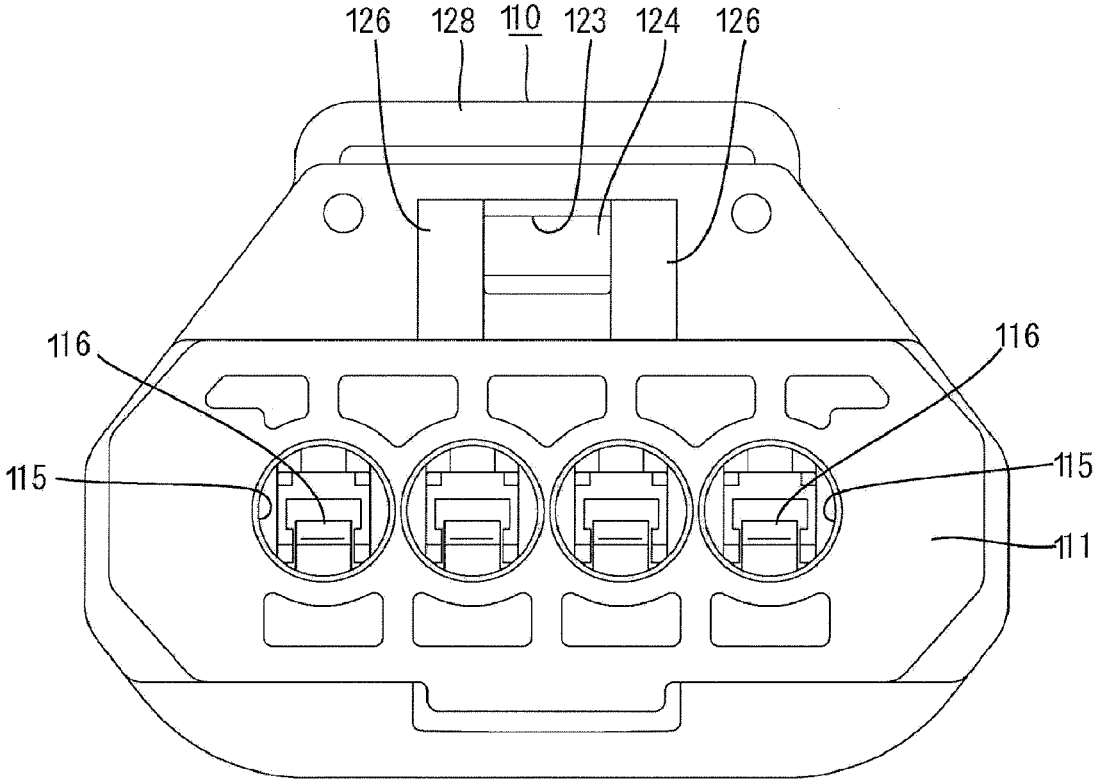
FIG. 11 is a rear view of the housing.

The housing 110 is made e.g. of synthetic resin and includes a substantially block-shaped housing main body 111 for accommodating terminal fittings 180. A fitting tube 112 at least partly surrounds the housing main body 111 and a joining portion 113 joins the fitting tube 112 and the housing main body 111, as shown in FIGS. 9 and 10. A forwardly open connection space 114 is defined between the housing main body 111 and the fitting tube 112 for the receptacle 161. The joining portion 113 extends between a part of the housing main body 111 slightly before a center in forward and backward directions FBD and the rear end of the fitting tube 112.

Cavities 115 extend in forward and backward directions FBD in the housing main body 111 and can accommodate the respective terminal fittings 180. A resiliently deformable locking lance 116 is formed at an inner surface of each cavity 115 and locks the terminal fitting 180 that has been inserted properly into the cavity 115.

Each terminal fitting 180 is formed unitarily by bending, folding and/or embossing an electrically conductive metal plate. The terminal fitting 180 has a substantially box-shaped tubular connecting portion 181 that can receive and connect with the tab 191. A wire connection portion is located behind the connecting portion 181 and is connectable with an end portion of a wire 170. The wire connection portion has at least one wire barrel 182 and at least one insulation barrel 183 located behind the connecting portion 181. The wire barrel 182 is crimped, bent or folded into connection with a conductor exposed at the end of the wire 170. The insulation barrel 183 is crimped, bent or folded into connection with a resilient or rubber plug 175 mounted on an insulation coating at the end portion of the wire 170. An inner circumferential surface of the plug 175 is held in close contact with the outer circumferential surface of the wire 170 and the outer circumferential surface is held in close contact with the inner circumferential surface of the cavity 115, thereby sealing the interior of the housing 110 in a fluid- or liquid-tight manner.

A step 117 is formed near the joining portion 113 in the housing main body 111, and a part behind the step 117 (side of the joining portion 113) is thicker than a part before the step 117. A seal ring 177 is mounted on the outer peripheral surface of the housing main body 111 before the step 117. The seal ring 177 is compressed resiliently between the receptacle 161 entering the connecting space 114 and the housing main body 111, thereby sealing between the two housings 110, 160 in a fluid- or liquid-tight manner.

A lock arm 118 is formed on the upper surface of the housing main body 111. The lock arm 118 includes a support 119 that is connected unitarily with the joining portion 113 and projects up from the upper surface of the housing main body 111. Left and right arm portions 121 extend forward from the support 119 along the connecting direction CD and a locking body 122 connects the leading ends of the arm portions 121. The arm portions 121 are substantially horizontal in a natural state, but are resiliently deformable about the support 119 in vertical directions that intersect the connecting direction CD. A lock groove 123 extends in forward and backward directions FBD between the arm portions 121. The lock groove 123 is behind the locking body 122 and opens in the rear surface of the lock arm 118. The mating lock claw 164 can fit into the lock groove 123 when connecting the two housings 110, 160. A locking surface 124 is defined on the rear surface of the locking body 122 and at the front end of the lock groove 123 for engaging with and locking the mating lock portion 162.

Figure 13:
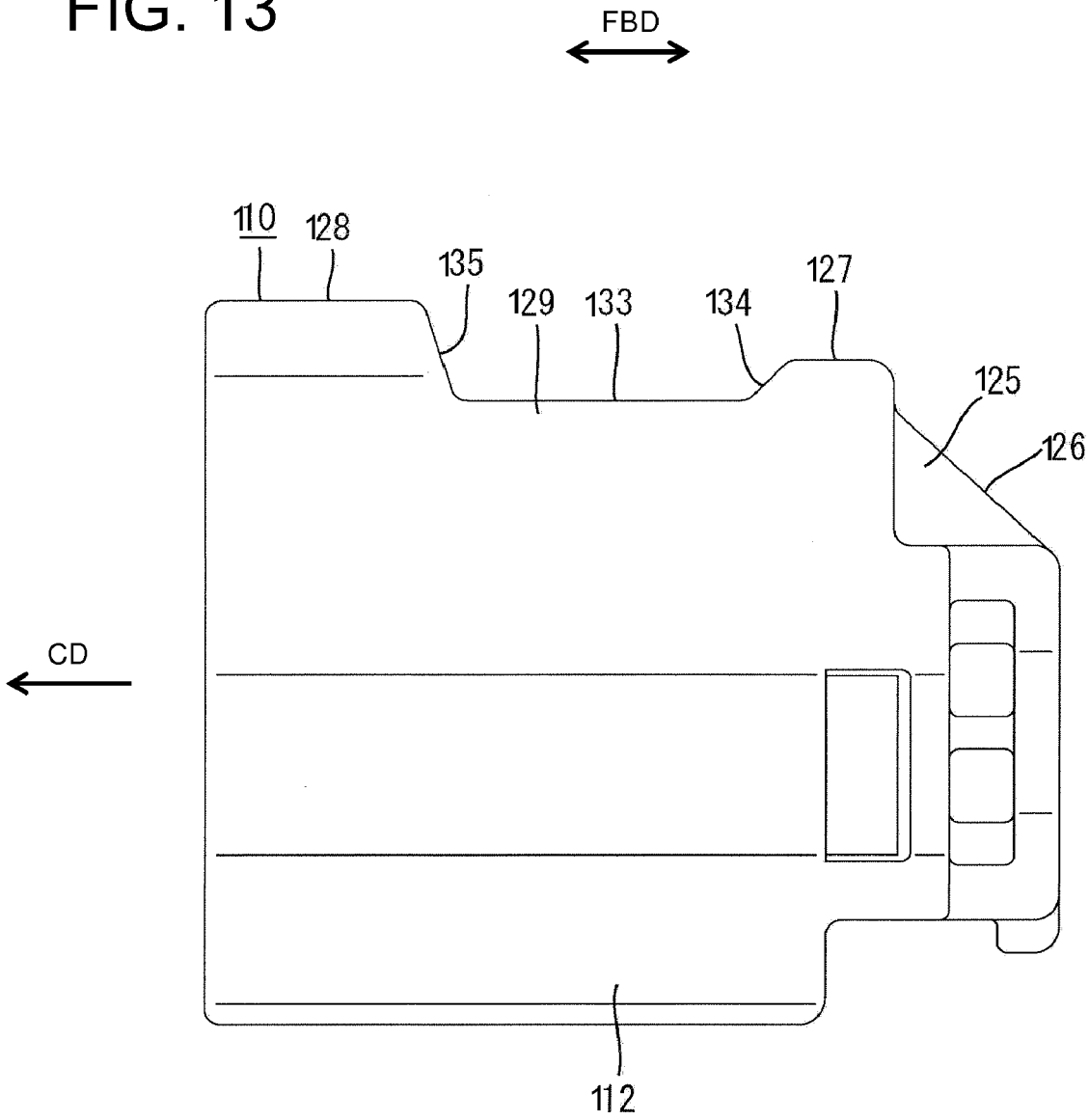
FIG. 13 is a side view of the housing.

As shown in FIG. 13, a pressable portion 125 is formed at the rear end of the support 119 and has a diverging or triangular shape when viewed sideways. The front end of the pressable portion 125 is connected unitarily with the rear surface of the support 119. The bottom end of the pressable portion 125 is connected unitarily with the upper surface of the housing main body 111 and the rear end of the pressable portion 125 inclines up and out in the connecting direction CD i.e. from the upper surface of the housing main body 111 to the rear surface of the support 119. A diverging pressable surface 126 is formed on the rear end of the pressable portion 125 and can be pressed by a finger or the like from behind when connecting the two housings 110, 160.

A first wall 127, a second wall 128 and left and right protection walls 129 are formed at an upper part of the fitting tube 112. As shown in FIG. 9, the first wall 127 covers base ends of both arm portions 121, and the rear end of the first wall 127 is connected unitarily with the upper end of the joining portion 113. The second wall 128 covers leading end portions of the arm portions 121 and the locking body 122. The second wall 128 is thicker and at a higher position than the first wall 127. An entrance space 131 is formed between the second wall 128 and the leading end of the lock arm 118 and can receive the mating lock portion 162 from the front. The entrance space 131 is open forward and communicates with the connection space 114.

Figure 12:
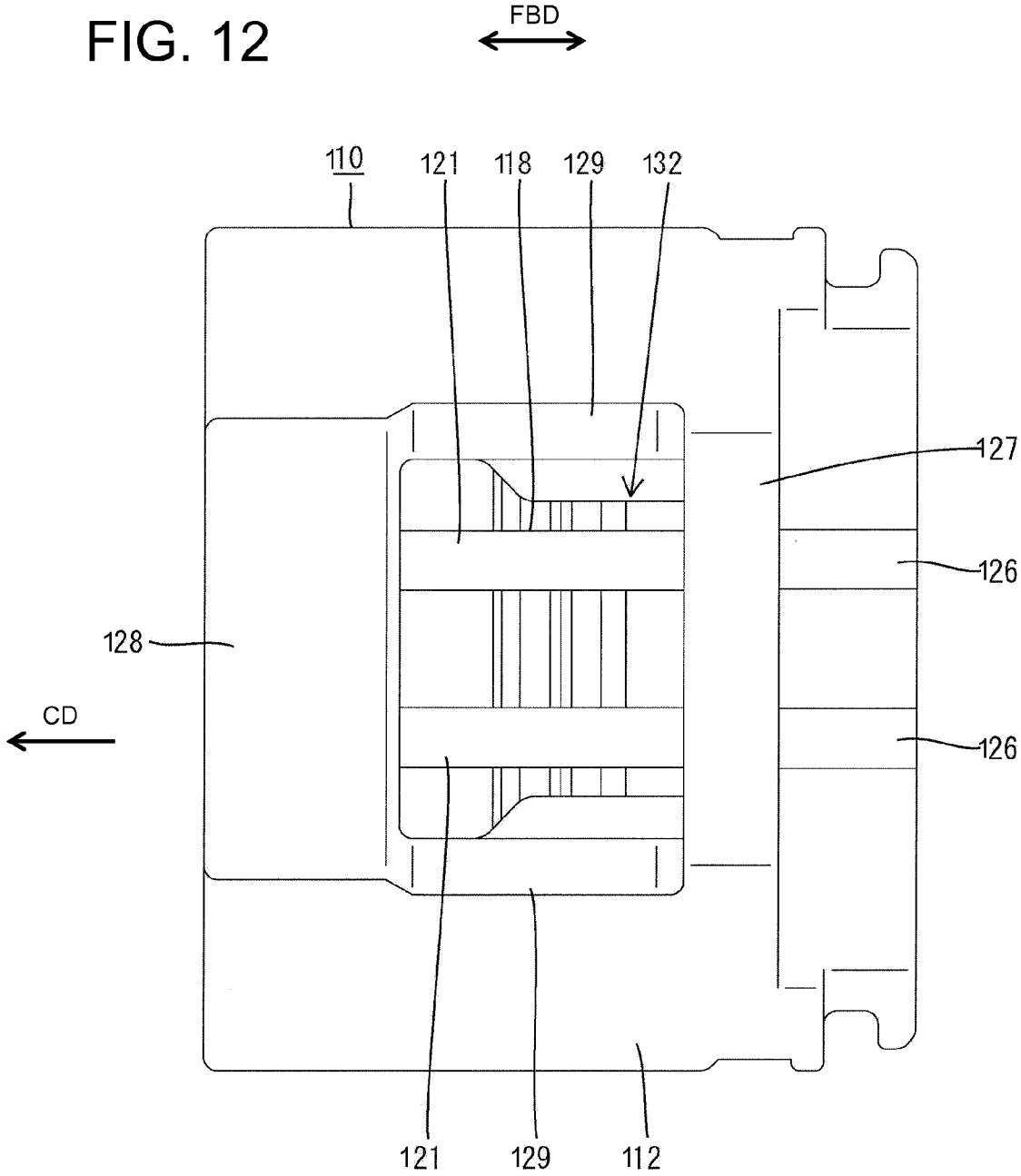
FIG. 12 is a plan view of the housing.

The two protection walls 129 are arranged at opposite sides of the lock arm 118. The rear ends of the protection walls are connected unitarily with the opposite left and right lateral ends of the first wall 127 and the front ends thereof are connected unitarily with the opposite left and right lateral ends of the second wall 128. As shown in FIG. 12, a substantially rectangular unlocking space 132 is defined between the first and second walls 127, 128 and between the protection walls 129. The opposite left and right lateral sides of the unlocking space 132 are closed by the two protection walls 129. Upper surfaces of intermediate parts of the arm portions 121 are located in the unlocking space 132. Thus, the lock arm 118 can be pressed by the tip of a finger F inserted into the unlocking space 132 and deformed resiliently down in unlocking direction (see FIG. 8).

The upper ends of the protection walls 129 are cut off to positions lower than the opposite front and rear ends thereof to form left and right recessed steps 133. The steps 133 are lower than the upper surfaces of the first and second walls 127, 128, but higher than the upper surfaces of the intermediate parts of the arm portions 121. Additionally, the upper surfaces of the steps 133 are substantially horizontal and substantially parallel with the upper surfaces of the first and second walls 127, 128 and the upper surfaces of the intermediate parts of the arm portions 121. First inclined surfaces 134 are formed on the protection walls 129 and incline up from the rear ends of the steps 133 to the upper end of the first wall 127. Additionally, second inclined surfaces 135 are formed on the protection walls 129 and incline up from the front ends of the steps 133 to the upper end of the second wall 128. The second inclined surfaces 135 are steeper than the first inclined surfaces 134 and are longer than the first inclined surfaces 134 by as much as the second wall 128 is located higher than the first wall 127. The steps 133 are near the upper surfaces of the arm portions 121 and an elevation difference between the steps 133 and the arm portions 121 is smaller than the thickness of the first wall 127.

As shown in FIG. 9, the wires 170 and the terminal fittings 180 having the respective resilient or rubber plugs 175 mounted thereon are inserted into the cavities 115 of the housing main body 111 from behind, and the seal ring 177 is mounted on the outer peripheral surface of the housing main body 111. The two housings 110, 160 then are arranged opposite to each other along the connecting direction CD and the connecting operation of the two housings 110, 160 is started. More particularly, the housing main body 111 can be inserted smoothly along the connecting direction CD into the receptacle 161 of the mating housing 160 by pushing the pressable surface 126 of the pressable portion 125 from behind and along the connecting direction CD e.g. with the finger. Thus, the mating lock 162 enters the entrance space 131 and the lock claw 164 interferes with the locking body 122 so that the lock arm 118 deforms down and in. The lock arm 118 resiliently returns when the two housings 110, 160 are connected properly. Accordingly, the lock claw 164 of the mating lock 162 enters the lock groove 123 so that the locking surface 124 and the engaging surface 165 face each other, as shown in FIG. 8, to hold the two housings 110, 160 in the connected state. The locking surface 124 and the engaging surface 165 are inclined at acute angles to directions opposite to separating directions of the two housings 110, 160, thereby increasing locking strength.

The mating lock 162 is located outside the unlocking space 132 when the two housings 110, 160 are connected properly, and hence is hidden by the fitting tube 112 when viewed sideways. Additionally, the tip of the mating lock 162 is closer to the locking body 122 than the second inclined surfaces 135 and is displaced from the steps 133 with respect to forward and backward directions.

The two housings 110, 160 may have to be separated for maintenance or the like. Thus, the finger F is inserted into the unlocking space 132 and the tip of the finger F is placed on the intermediate parts of the arm portions 122 to press and deflect the arm portions 122 down in the unlocking direction. The arm portions 121 deform resiliently down about the support 119 and, simultaneously, the lock claw 164 is separated from the lock groove 123 to cancel the locked state by the lock arm 118. The two housings 110, 160 the are pulled in opposite directions and separated.

The steps 133 of the protection walls 129 reduce an elevation difference between the steps 133 and the arm portions 133 to make the unlocking space 132 shallower. Thus, the tip of the finger F can be brought into contact with the intermediate parts of the arm portions 121 without inserting the finger F deeply into the unlocking space 132. Therefore, good operability is realized and the operation of unlocking the lock arm 118 is not hindered by interference of the tip of the finger F with the protection walls 129. On the other hand, the protection walls 129 are arranged at the opposite outer sides of the lock arm 118 to prevent interference of external matter with the lock arm 118 from outer lateral sides. The lock arm 118 can be pressed with the central part of the tip of the finger F while the opposite lateral sides of the tip of the finger F are placed on the steps 133. Thus, the first and second inclined surfaces 134, 135 guide the finger F into the unlocking space 132.

Further, the mating lock 162 is arranged outside the unlocking space 132 in the connected state of the two housings 110, 160 to avoid interference of the tip of the finger F with the mating lock 162 when the finger F is inserted into the unlocking space 132. Therefore smooth operability is ensured during the unlocking operation.

Furthermore, the steps 133 are displaced from the mating lock portion 162 so that the mating lock portion 162 is hidden when viewed sideways in the connected state of the two housings 110, 160. Thus, external matter will not interfere with the mating lock 162 from the outer lateral sides so that the locked state of the mating lock 162 and the lock arm 118 will not be canceled accidentally.

The invention is not limited to the above described and illustrated embodiments. For example, the following modifications are also included in the technical scope of the present invention.

The pressable portions may be at a distance behind the support.

The distance between the opposite widthwise ends of the pressable portions may be longer than the distance between the opposite widthwise ends of the arm portion.

The upper end of the rear wall may be higher than that of the front wall. In this case as well, the effect of the second embodiment can be enjoyed.

The housing may be a male housing capable of accommodating male terminal fittings including male tabs and the mating housing may be a female housing capable of accommodating female terminal fittings.

The rear wall may be omitted.

The first and second walls may be arranged at the same height.

Upon separating the two housings from each other, it is also possible to insert a jig into the unlocking space instead of the finger and resiliently deform the lock arm in the unlocking direction with the tip of the jig.

What is claimed is:

1. A connector, comprising:

a housing connectable with a mating housing;

at least one lock arm including a support projecting from the housing and a resiliently deformable arm portion cantilevered substantially forward in a connecting direction from the support, the arm portion being adapted to hold the two housings in a connected state by a locking movement of the arm portion when the two housings are connected properly;

at least one pressable portion unitary with the housing and the support, the pressable portion being located behind the support in the connecting direction;

a front wall at least partly covering a free end of the arm portion; and a rear wall at least partly covering the support and an end of the arm portion adjacent the support, the rear wall being spaced from the front wall so that an unlocking space is defined between the front wall and the rear wall for permitting entry of a finger for deforming the arm portion, and a rearwardly facing finger stop on the rear wall stepped up from the pressable portion, the finger stop preventing a finger placed on the pressable portion in a connecting process from inadvertently moving forward and into contact with the arm portion.

2. The connector of claim 1, wherein a distance between opposite widthwise sides of the pressable portion in a width direction orthogonal to the connecting direction substantially equals or exceeds a distance between opposite widthwise sides of the arm portion.

3. The connector of claim 1, wherein the rear wall is at least as high as the front wall in a height direction orthogonal to the connecting direction.

4. The connector of claim 1, wherein:

the arm portion includes two arm bodies spaced apart in a width direction orthogonal to the connecting direction; and the at least one pressable portion comprises two pressable portions substantially aligned with the respective arm bodies.

5. The connector of claim 1, wherein the pressable portion includes at least one pressable surface inclined toward a side toward which the support projects.

6. A connector, comprising:

a housing connectable with a mating housing, at least one lock arm cantilevered on the housing and extending from a base end to a leading end that is adapted to hold the housing in a connected state, a first wall formed on the housing and arranged to cover the base end of the lock arm, a second wall formed on the housing and arranged to cover the leading end of the lock arm, an unlocking space being defined between the first wall and the second wall and being accessible to perform an unlocking operation to an intermediate part of the lock arm; and left and right protection walls projecting from the housing and arranged at opposite sides of the lock arm to close the unlocking space, the protection walls being cut off to positions more inward than the first and second walls and more outward than the intermediate part of the lock arm, thereby forming at least one step, a first inclined surface inclined from a rear end of the step to an upper end of the first wall and a second inclined surface inclined from the front end of the step to an upper surface of the second wall, wherein the first and second inclined surfaces guide a finger into the unlocking space.

7. The connector of claim 6, wherein the mating housing has a mating lock portion engageable with the lock arm for locking, the mating lock being arranged outside the unlocking space in a connected state of the two housings.

8. The connector of claim 7, wherein the step is displaced from the mating lock so that the mating lock is hidden when viewed sideways in the connected state of the two housings.

* * * * *